US005131879A

United States Patent [19]

Bouchakian

[11] Patent Number: 5,131,879

[45] Date of Patent: Jul. 21, 1992

[54] BI-ELLIPTICAL FLYING TOY

[76] Inventor: Myron Bouchakian, 2310 Jupiter Dr, Los Angeles, Calif. 90046

[21] Appl. No.: 748,545

[22] Filed: Aug. 22, 1991

[51] Int. Cl.[5] ..... A63H 27/00

[52] U.S. Cl. ..... 446/48; D21/86

[58] Field of Search ..... 446/46–48; 273/424, 425, 428; D21/86, 85

[56] References Cited

U.S. PATENT DOCUMENTS 3,594,945 7/1971 Turney ..... 446/48
3,673,732 7/1972 Liotta ..... 446/46
4,182,073 1/1980 Tabet ..... 446/46
4,560,358 12/1985 Adler ..... 273/425 X

FOREIGN PATENT DOCUMENTS 198515 6/1923 United Kingdom .

*Primary Examiner*—Mickey Yu
*Attorney, Agent, or Firm*—H. Jay Spiegel

[57] ABSTRACT

A flying toy is disclosed which consists of two elliptical rings mounted together in vertically spaced relation with their long axes perpendicular to one another. Struts having hyperbolic walls are used to mount the rings together. Each ring is made up of multiple airfoils of differing widths and thicknesses which merge together about the circumference of each ring.

6 Claims, 4 Drawing Sheets

BI-ELLIPTICAL FLYING TOY

BACKGROUND OF THE INVENTION

The present invention relates to a bi-elliptical flying toy. In the prior art, flying discs and rings are known, as are such devices having plural discs mounted together. However, Applicant is unaware of any such device including all of the features and aspects of the present invention.

The following prior art is known to Applicant:

U.S. Pat. No. 3,758,985 to Heisler discloses a discus toy having two generally hemispheric inflatable members. The present invention differs from the teachings of Heisler as including two elliptical rings mounted together with their major axes at right angles.

U.S. Pat. No. 3,855,728 to Hynds discloses an aerodynamic toy having two disks which separate when thrown. The present invention differs from the teachings of Hynds as including two rings which remain attached in spaced relation at all times.

U.S. Pat. No. 4,104,822 to Rodgers discloses a rotating circular airfoil which is in the nature of a ring. The present invention differs from the teachings of this patent as incorporating elliptical airfoils having various regions differing in width and thickness and having cross-sectional configurations differing from the teachings of Rodgers as well.

U.S. Pat. No. 4,117,626 to Kifferstein et al. discloses a toy flying saucer having a plurality of discs of differing sizes mounted together. The present invention differs from the teachings of Kifferstein et al. as including the provision of two elliptical rings mounted with their major axes perpendicular to one another.

U.S. Pat. No. 4,182,073 to Tabet discloses a twin flying saucer toy having two discs mounted in vertically spaced relation through the provision of sleeves and pins apparently of generally cylindrical configuration. The present invention differs from the teachings of Tabet as including two elliptical rings mounted together with their axes perpendicular to one another by struts having hyperbolic side walls.

U.S. Pat. No. 4,288,942 to Nicholl discloses an aerodynamic device consisting of an outer disk having an opening therethrough and an inner disk mounted within the outer disk. The present invention differs from the teachings of Nicholl as disclosing two elliptical rings mounted together with their major axes perpendicular to one another.

U.S. Pat. No. 4,752,267 to Layman discloses a double flying disc having two discs mounted together by a collapsible support allowing the discs to be thrown in a close configuration and to expand away from one another during flight. The present invention differs from the teachings of Layman as including two elliptical rings mounted together with their major axes perpendicular to one another and which rings are fixedly mounted with respect to one another.

Additionally, the following U.S. Pat. Nos. are known to Applicant but are believed to be of only general background interest concerning the teachings of the present invention:

| | |
|---|---|
| 3,113,396 to Collins | 4,132,031 to Psyras |
| 3,407,514 to Christian | 4,216,962 to Flemming |
| 3,545,760 to Wilson | 4,681,553 to Rodarte |

SUMMARY OF THE INVENTION

The present invention relates to a bi-elliptical flying toy. The present invention includes the following interrelated objects, aspects and features:

(A) In a first aspect, the inventive flying toy is made up of two rings connected together by struts. Each ring consists of an elliptical configuration including two thin and narrow regions merging with two thicker and wider regions at transition regions.

(B) Each ring has a cross-section which is generally arcuate and which terminates at each extreme end thereof by a generally semi-circular protrusion.

(C) The rings are mounted together with their major axes generally perpendicular to one another. The means for mounting the rings together in this configuration consists of a plurality of struts, preferably four in number, each of which has side walls which are hyperbolic in nature. The vertical cross-section of a strut reveals two hyperbolae which are configured so that their central regions are closer to one another than their extreme regions.

(D) When the inventive flying toy is thrown, it tends to arrive at a hovering configuration not unlike a helicopter as the oblong ends of the elliptical rings serve as "gyroscopic blades" to provide stability.

As such, it is a first object of the present invention to provide a bi-elliptical flying toy.

It is a further object of the present invention to provide such a device wherein two elliptical rings are mounted together with their major axes perpendicular to one another.

It is a yet further object of the present invention to provide such a device wherein the rings are mounted together through the use of hyperbolically configured struts.

It is a yet further object of the present invention to provide such a device wherein each ring includes thin, narrow regions merging into thick, wider regions at transition regions.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
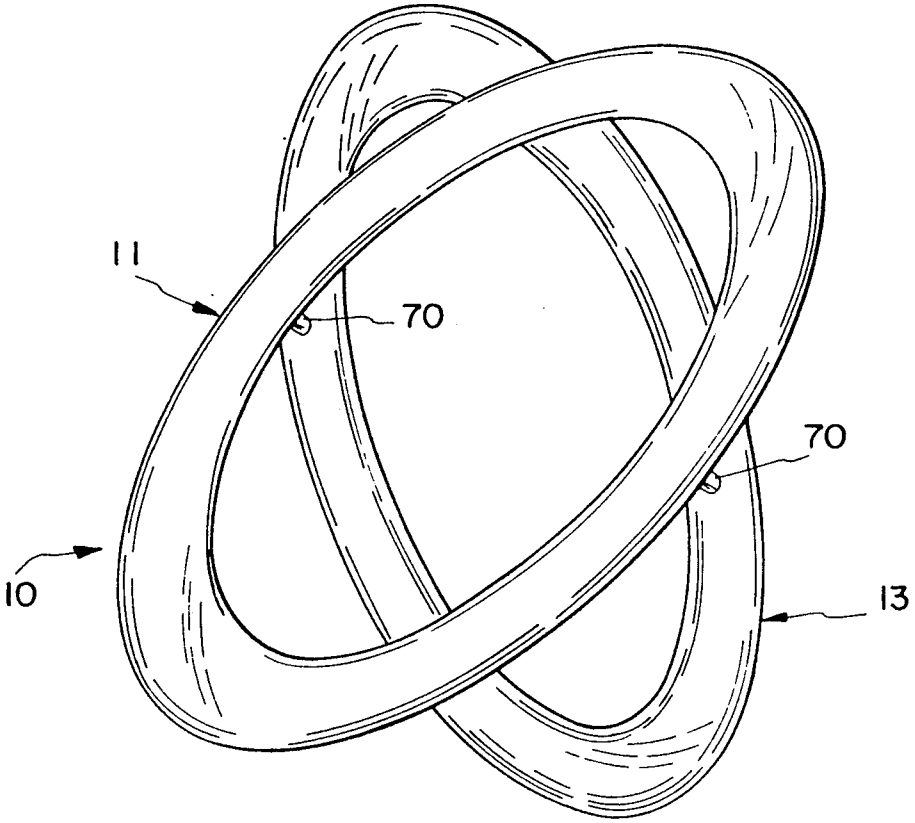
FIG. 1 shows an oblique front view of the present invention.
Figure 4:
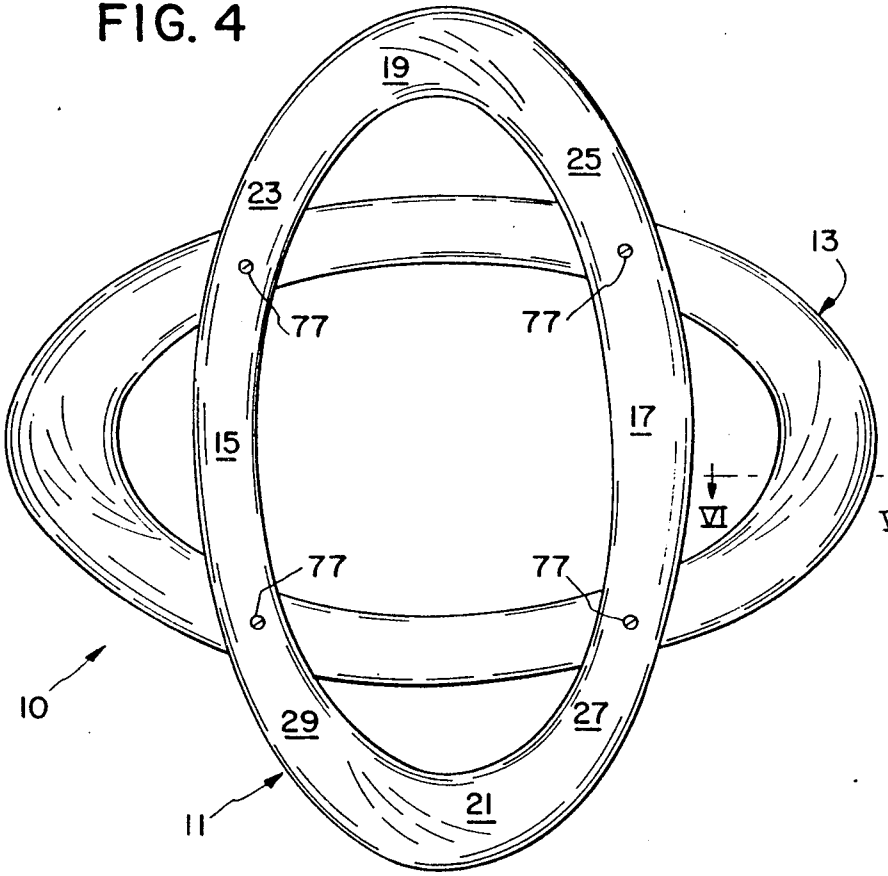
FIG. 4 shows a top view of the present invention.

With reference, first, to FIG. 1, the inventive bi-elliptical flying toy is generally designated by the reference numeral 10 and is seen to include an upper ring 11 and a lower ring 13. With reference to FIG. 4, it is seen that the upper ring 11 is elliptical in shape having a major axis vertically oriented in the view of FIG. 4 and a minor axis which is horizontally oriented in the same view. The ring 11 has relatively thinner, narrower regions 15, 17, relatively wider, thicker regions 19, 21 and four transition regions, including the transition region 23 between the regions 15 and 19, the transition region 25 between the regions 17 and 19, the transition region 27 between the regions 17 and 21 and the transition region 29 between the regions 15 and 21. As should be understood from the view of FIG. 4, as one goes about the circumference of the ring 11, the transition regions are between respective narrower, thinner regions and wider, thicker regions and allow a smooth transition on the surfaces of the ring 11 between thinner, narrower regions and thicker, wider regions.

Figure 5:
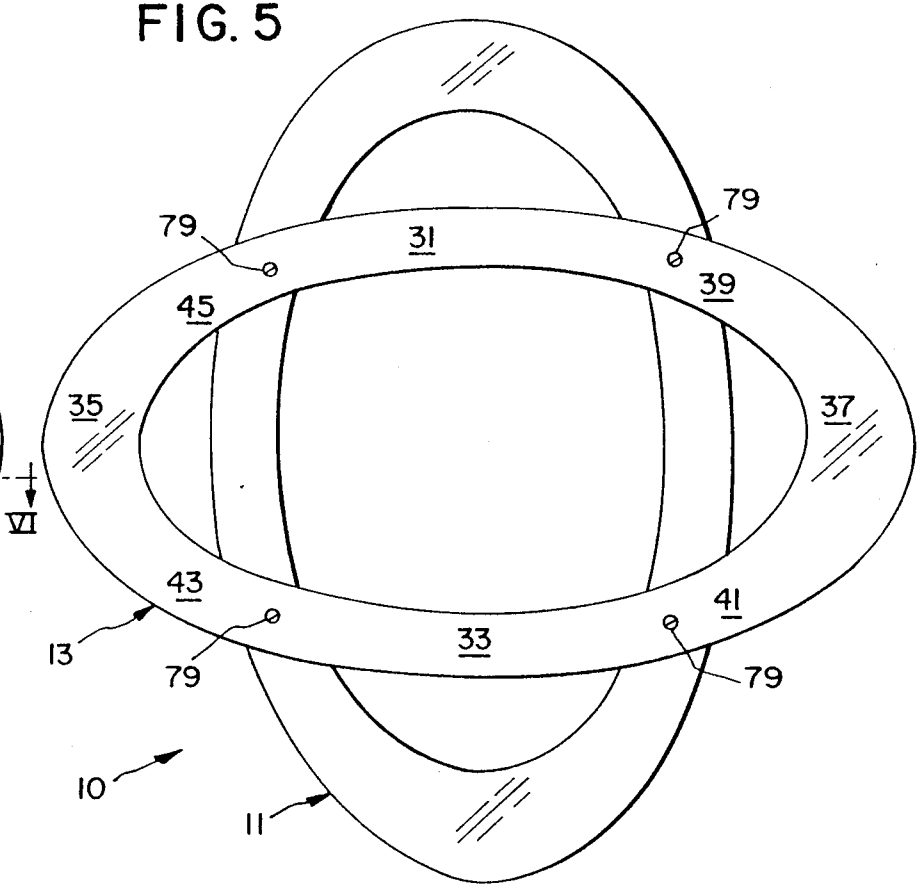
FIG. 5 shows a bottom view of the present invention.

With reference to FIG. 5, it is seen that the lower ring 13 includes thinner, narrower regions 31, 33, relatively thicker, wider regions 35, 37 and transition regions 39, 41, 43 and 45. The transition region 39 is between the regions 31, 37; the transition region 41 is between the regions 33 and 37; the transition region 43 is between the regions 33 and 35; and the transition region 45 is between the regions 31 and 35. The rings 11 and 13 are identical to one another.

Figure 6:
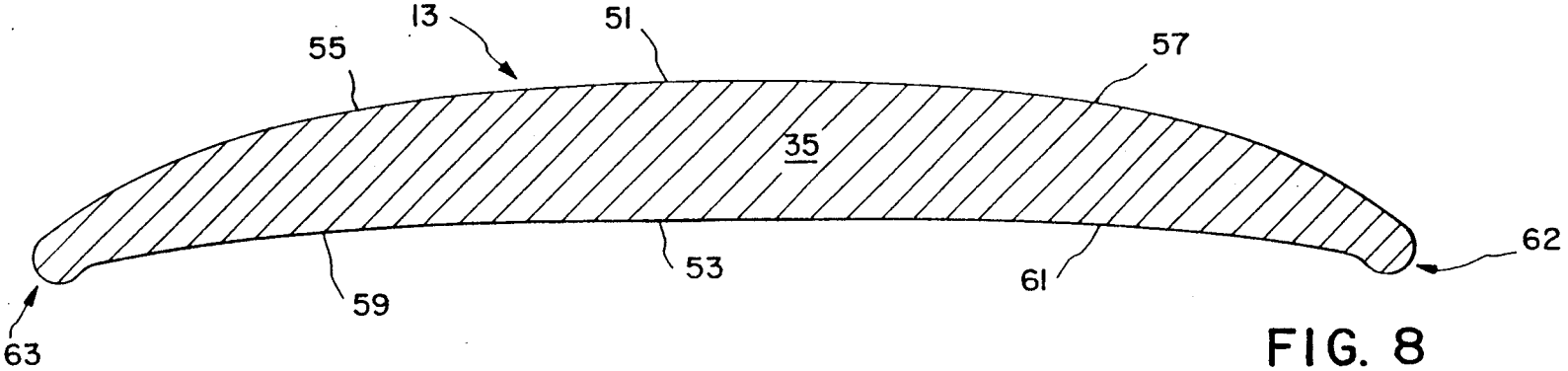
FIG. 6 shows an enlarged cross-sectional view along the line VI—VI of FIG. 4.

FIG. 6 shows a cross-sectional view of the region 35 of the ring 13. This cross-sectional view is representative of the cross-section of each ring throughout its circumference. In the thinner, narrower regions such as, for example, the regions 31 and 33, the dimensions shown in FIG. 6 will be narrower and thinner. However, the general shape and outline will conform to that which is shown in FIG. 6.

With reference to FIG. 6, the cross-section is seen to include upper and lower central portions 51 and 53 which are generally flat. To either side of the central portion 51, arcuate side regions 55 and 57 are provided. The lower central portion 53 has two side regions adjacent thereto designated by the reference numerals 59 and 61 which are also arcuate but on a greater radius of curvature than the regions 55 and 57.

Figure 7:
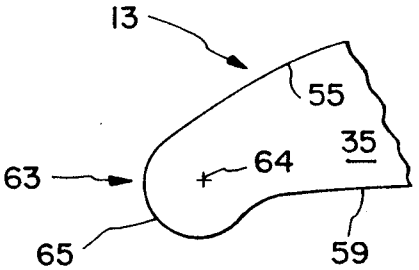
FIG. 7 shows a further enlarged view of the portion of FIG. 6 which is contained within the circle.

With reference to FIG. 7, the regions 55 and 59 are seen to converge at a generally semi-circular protrusion 63 which has a center point 64. As shown, the configuration of the protrusion 63 consists of an outer circular surface 65 which "droops" down below the arcuate region 59. The protrusion 62 on the other side of the ring 13 is symmetrical with the protrusion 63. As should be understood, the ring 13 as well as the ring 11 have this same structure, with the actual structure consisting of an annulus projecting the protrusions 62, 63 about the circumference of the ring 13 and in analogous fashion concerning the ring 11.

Figure 2:
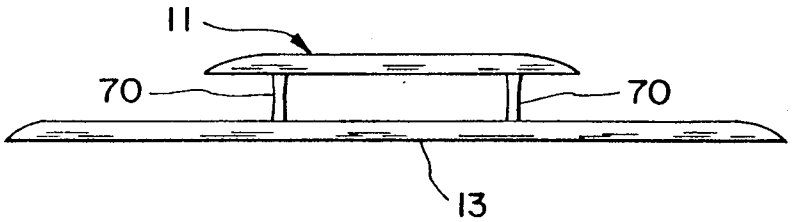
FIG. 2 shows an end view along the major axis of the lower one of the rings of the present invention.
Figure 3:
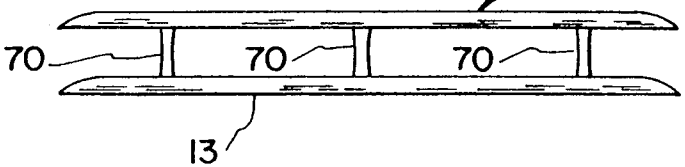
FIG. 3 shows a further end view rotated 45° from the view of FIG. 2.
Figure 8:
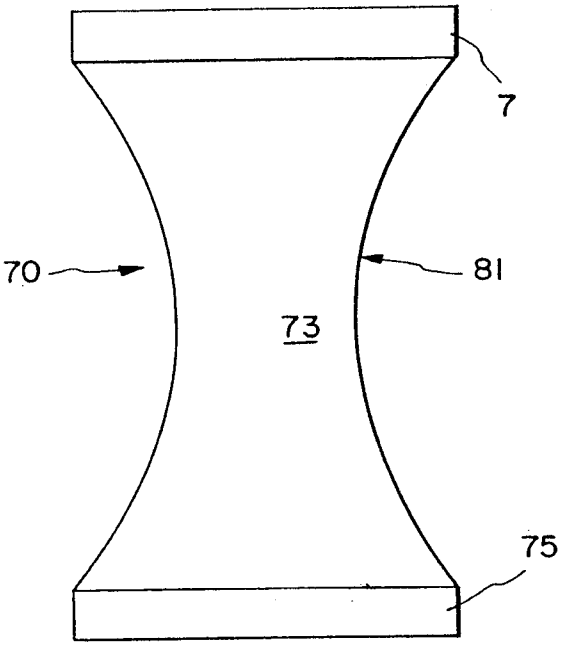
FIG. 8 shows an enlarged cross-sectional view of one of the struts of the present invention.

FIG. 8 shows a strut 70. Four such struts 70 are used to hold the rings 11, 13 in the mounted orientation with respect to one another as best seen in FIGS. 1, 2 and 3. As seen in FIG. 8, the strut 70 has a top portion 71, a central region 73 and a bottom portion 75. The portions 71 and 75 are attached to the rings 11 and 13 respectively. FIG. 4 shows screws 77 which may be fastened through the ring 11 and into the respective top portions 71 of the struts 70 to fasten the ring 11 thereto. Similarly, with reference to FIG. 5, screws 79 may be provided to allow fastening of the ring 13 to the bottom portions 75 of the struts 70. Of course, the screws 77, 79 are merely exemplary of the means which may be employed to fasten the struts 70 between the rings 11, 13. Any suitable means such as adhesive, screws, bolts, etc. may be suitably employed. In the case of the screws 77, 79, it is only important to note that they are employed in a manner such that their top surfaces are flush with the corresponding surfaces of the rings 11, 13 so that the screws 77, 79 do nothing to effect the aerodynamics of the inventive device 10.

With further reference to FIG. 8, it is seen that the strut 70 has, in its central region 73, a peripheral wall 81 which, in cross-section, consists of two hyperbolae having configurations which converge toward one another in the center of the strut 70. The surface 81 is annular and surrounds the central region 73 defining its extent. The hyperbolic nature of the struts 70 is intentionally provided to correct aerodynamics by decreasing air drag below what drag would be were the struts to be cylindrical, while improving the strength of the connection between the upper and lower rings 11, 13 respectively. If desired, the inventive device 10 may be manufactured in one piece with the top portion 71 of each strut 70 being integral with the ring 11 and with the bottom portion 75 of each strut 70 being integral with the bottom ring 13.

Figure 9:
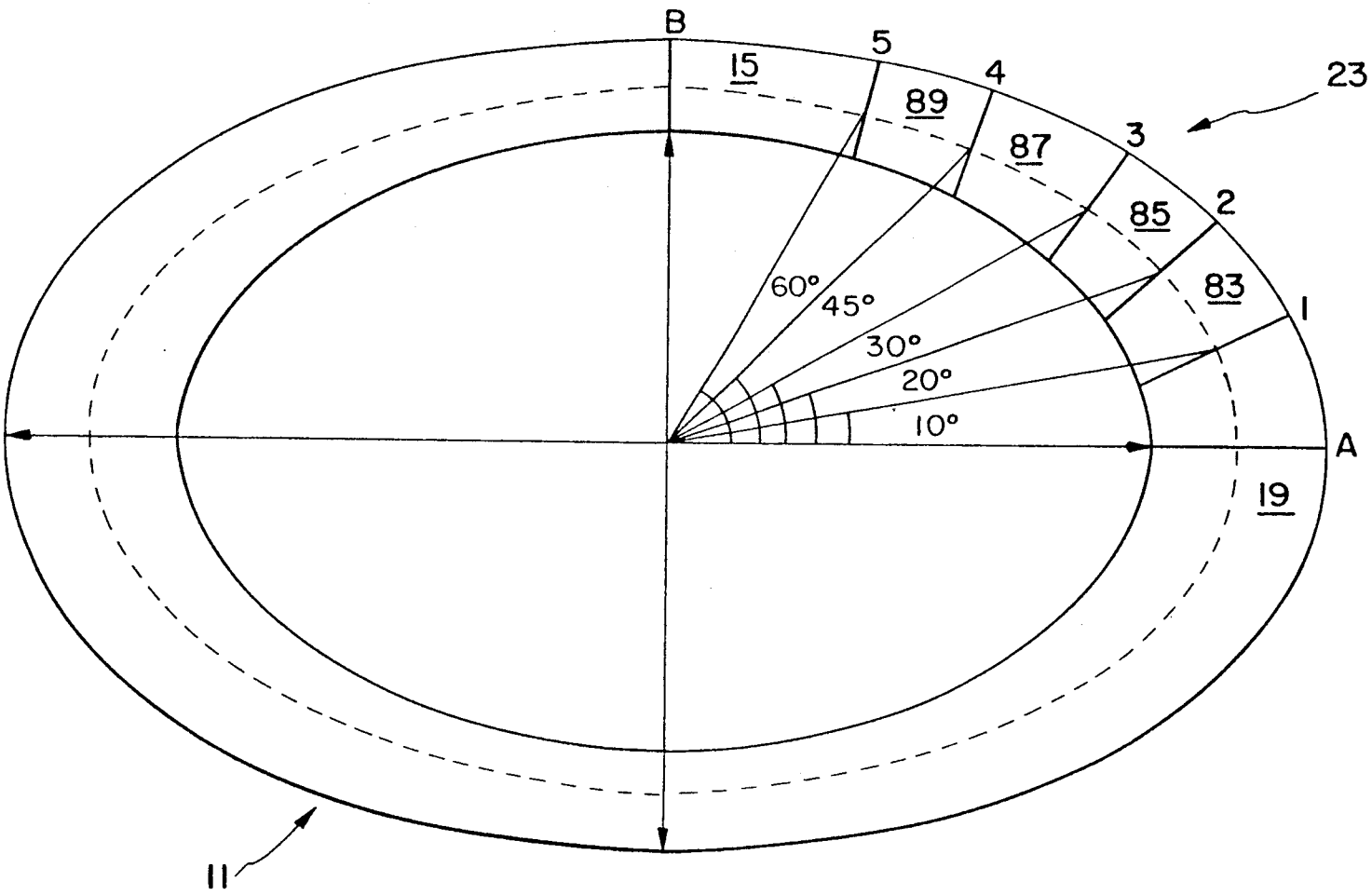
FIG. 9 shows a schematic representation of one of the inventive rings, viewed from above.

With reference, now, to FIG. 9, further details concerning the various regions on a ring made in accordance with the teachings of the present invention will now be disclosed. For purposes of discussion, the FIG. 9 ring will be explained with reference to the reference numerals depicting the ring 11. Thus, the ring 11 has a region 19 which is relatively wider and thicker, a region 15 which is relatively thinner and narrower and a transition region 23 therebetween. As seen in FIG. 9, the transition region 23 may be considered to be divided up into four sub-regions designated by the reference numerals 83, 85, 87 and 89. Thus, in each quadrant of the ring 11, there are six airfoils integrated and smoothed around the periphery of the ring 11 to provide smooth transitions therebetween.

Thus, the present invention contemplates a dynamically balanced flying toy having two elliptical rings fixedly mounted together using hyperbolic struts and with the major axes of the rings being perpendicular to one another. If desired, the rings may be made in different colors with respect to one another so that when the inventive flying toy 10 is thrown, a fluttering visual effect will result, which is aesthetically pleasing for the user and viewers. When the inventive device is thrown, it eventually begins to hover like a helicopter as the oblong ends of the elliptical rings serve as gyroscopic blades, providing stability as the toy 10 descends to the ground.

As such, an invention has been disclosed in terms of a preferred embodiment thereof which fulfills each and every one of the objects of the present invention as set forth hereinabove and provides a new and useful bi-elliptical flying toy of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A flying toy, comprising:

a) a first generally elliptical ring having a first first major axis of elongation;

b) a second generally elliptical ring having a second second major axis of elongation;

c) said rings being mounted together in spaced relation relation by a plurality of struts; and d) said axes of elongation being angularly displaced from one another in non-parallel relation.

2. The invention of claim 1, wherein said first axis and second axis are perpendicular to one another.

3. The invention of claim 1, wherein said plurality of struts comprises four struts.

4. The invention of claim 3, wherein each strut has an exterior hyperbolic wall.

5. The invention of claim 1, wherein each said ring includes two opposed relatively wider, thicker regions and two opposed relatively narrower, thinner regions.

6. The invention of claim 5, wherein each said ring includes a plurality of transition regions, each transition region being located between one wider, thicker region and one narrower, thinner region to provide a smooth transition therebetween.

* * * * *